US005514854A

United States Patent [19]

Atsaves

[11] Patent Number: 5,514,854

[45] Date of Patent: May 7, 1996

[54] GUSSETED MICROWAVE POPCORN BAG WITH SUSCEPTOR

[75] Inventor: James J. Atsaves, Lake Forest, Ill.

[73] Assignee: Epic Associates, Ltd., Park Ridge, Ill.

[21] Appl. No.: 294,267

[22] Filed: Aug. 23, 1994

[51] Int. Cl.[6] ..... H05B 6/80

[52] U.S. Cl. ..... 219/727; 219/730; 99/DIG. 14; 426/107; 426/234

[58] Field of Search ..... 219/727, 730; 99/DIG. 14; 426/107, 109, 234, 241, 243

[56] References Cited

U.S. PATENT DOCUMENTS

| | | | |
|---|---|---|---|
| 3,973,045 | 8/1976 | Brandberg et al. | 426/234 |
| 4,450,180 | 5/1984 | Watkins . | |
| 4,548,826 | 10/1985 | Watkins . | |
| 4,571,337 | 2/1986 | Cage et al. . | |
| 4,691,374 | 9/1987 | Watkins et al. . | |
| 4,973,810 | 11/1990 | Brauner | 219/727 |
| 5,044,777 | 9/1991 | Watkins et al. . | |
| 5,081,330 | 1/1992 | Brandberg et al. | 219/727 |
| 5,189,272 | 2/1993 | McDonald et al. | 219/727 |
| 5,294,765 | 3/1994 | Archibald et al. | 219/727 |
| 5,405,663 | 4/1995 | Archibald et al. | 428/34.3 |

*Primary Examiner*—Philip H. Leung
*Attorney, Agent, or Firm*—Gerald S. Geren

[57] ABSTRACT

A bag for carrying corn kernels for popping in a microwave oven. The bag has front, back, and gusseted side panels and carries a susceptor for receiving microwave energy and heating the corn for popping. In general, the bag is of the single gusset tube type with a V-shaped bottom. The bag has winged end constructions where the seals are entirely internal, in a linear zone or band that extends from side-to-side, (i.e. transversely of the bag length). The top seal is not as strong as the bottom seal, so as to permit top venting. In the winged construction the front and back panel centers are adhered together and gusset folds are secured to an adjacent front or back panel. Upon bag expansion the bag has an increased internal volume for its size, minimizes tilting and maximizes susceptor/oven floor contact and can be set upright on the bottom end winged construction. This bag structure provides for more complete popping and for a more pleasing pillow shape for the bag.

10 Claims, 1 Drawing Sheet

GUSSETED MICROWAVE POPCORN BAG WITH SUSCEPTOR

BACKGROUND OF THE INVENTION

This invention relates to bags that carry corn kernels and are used in popping the corn in a microwave oven, and more particularly to the construction for such a bag.

Bags for use in carrying corn and popping the corn in a microwave oven are known. See for example U.S. Pat. Nos. 4,450,180; 4,548,826; 4,571,337; 4,691,374 and 5,044,777. A frequently used bag is known as the pinch bottom bag and is fabricated from a laminated web of material that is folded and glued. The bag has a front panel, a back panel, a pair of gusseted or folded side panels each of which is connected with the front and the back panel, and a susceptor for receiving the microwave energy and heating the corn kernels.

In this type of bag a flap is formed from the bottom, is folded up therefrom and adhered to the back of the bag so as to close the bottom from side-to-side. This type of end has been referred to as a pinch bottom as opposed to a square bottom. In a recent modification the flap has been eliminated and the bag is sealed closed from side-to-side by an adhesive which completely closes and adheres the front, back and side panels together along interior edges. Glue on the exterior closes the gusset folds at the bottom.

At the top end, the bag is sealed closed and the bonding is along interior edges of the bag. Moreover, the seal at the top is not as strong as that for the bottom. This top construction and sealing permits steam and expanded air to exit the bag as the corn is popped, even though the bottom remains closed.

In a typical situation a bag is folded and formed from the web and the top is open. With the bag top open the bag is then filled with the corn, oil and seasoning. The top of the bag is then closed and the bag is folded so as to form a center section with the ingredients and the ends are folded thereover. The shape is somewhat like a packet with the end flaps folded over the center section. This packet is unfolded and placed in a microwave oven with the flaps opened and the susceptor against the oven floor, where the microwave energy interacts with the susceptor and pops the corn. Steam from the popping exits the top end of the bag.

However, it has been found that some corn kernels move to, and are trapped at the bottom end, particularly in the end gusset folds and do not pop. Sometimes popped corn clumps at the bottom end.

Therefore, it is an object of this invention to provide a bag structure which will minimize the problems of trapping kernels and clumping.

It has also been found that when kernels do not pop, the bag assumes a sloping configuration, rather than the more desirable pillow shape. This sloping can cause the bag to undesirably tilt and the susceptor to tilt out of contact with the oven floor. This in turn may cause the corn to shift and the popping to be uneven. The pillow configuration is more desirable since the tilting may be eliminated or minimized, aesthetically the bag appears more acceptable, there is more surface exposed to carry advertisements, and the bag has a greater internal volume.

Thus, it is another object to provide a bag which will adopt a pillow shape when the kernels are popped.

It has also been found that if the microwave oven is older, not operating efficiently or of a low power or wattage, trapped kernels may not pop.

Thus, it is an even further object of this invention to provide a bag structure which is effective with both newer and older microwave oven units.

In an effort to solve these types of problems, a seal jaw design was developed using a diagonal glue line which formed a triangular gusset adjacent the end. This is seen in U.S. Pat. No. 5,044,777. However, this design requires the use of additional glue in the outside gusset and limits bag expansion by preventing unfolding at the ends. In other words, the bag internal volume reduced. Thus, the bag solved some, but not all of the pre-existing problems.

Other objects of this invention are to avoid the gusset gluing procedure, maximize unfolding and internal volume and maximize the popping of kernels.

Generally, it is desirable to provide the foregoing advantages, minimize the cost for changes while maximizing the functionalbility of the bag.

These and other objects of this invention will become apparent from the following description and appended claims.

SUMMARY OF THIS INVENTION

This invention meets the foregoing objects and provides an improved bag which is readily and efficiently manufactured. Moreover, the bag is advantageous in use and aids in maximizing the popping of corn.

The bag includes front, back and gusseted side panels and an appropriately located susceptor. Moreover, the bag has closed top and bottom ends. The end contruction for the top and bottom ends can be characterized as a winged structure where the middle is sealed and at each end of the middle there is a pair of V-shaped wings. But, the bottom end seal is stronger than the top end seal so as to permit the needed top venting while still assuring sealing.

Usually, the middle is formed by the sealing the front panel to the back panel. The wings are formed by each of the gusseted (or folded) side panels being joined to a front or a back panel. In other words, each half of the gusset is secured to an adjacent front or back panel, but is free to unfold or to move away from the other half of the gusset. Also, the adhesive for the bottom is only on the inside edge of the bag and not on the outside edge. The bottom glue is provided in an essentially straight band or zone that is transverse to the bag. Thus, the gussets are glued in the same way as the middle.

This construction minimizes the corn kernels trapped in the end, maximizes popping, prevents the bag from sagging at one end and provides the desirable pillow-like shape for the bag. It may be said that this bag has a greater internal volume for a given surface area than prior bags. More specifically, this construction also minimizes popcorn clumping which may occur at the bag corners, since the gussets are now able to unfold.

Moreover, it has been found that an expanded bag can be set upright on its lower end and the winged construction provides a stand to hold the bag in the vertical position where the contents are contained and do not spill and the front panel advertisement can be seen.

DESCRIPTION OF THE PREFERRED EMBODIMENT

Figure 1:
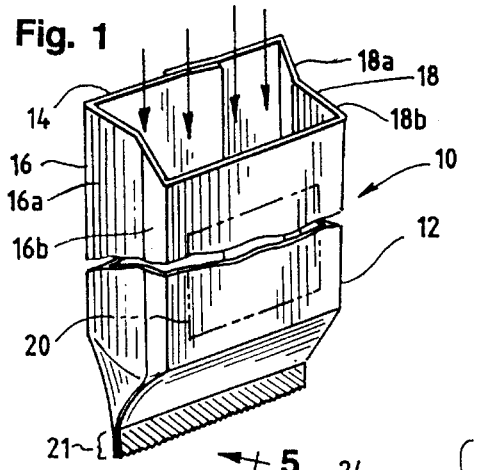
FIG. 1 is a perspective view of the bag of this invention with the bag bottom closed and material being loaded into the bag from the open top.
Figure 2:
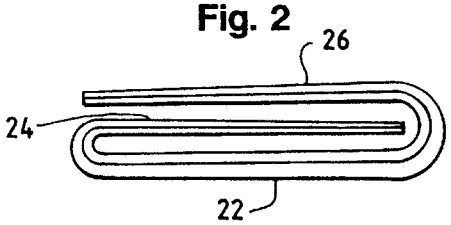
FIG. 2 is a side view of a closed and folded bag or packet.

Referring to FIG. 1, the bag 10 is fabricated from a web of material (not shown). The bag is formed and folded into a tube-like shape, and has a front panel 12, a seamed back panel 14 and a pair of gusseted side panels 16 and 18 that join the front and back panels 12 and 14. Gussetted side panel, as used herein means a folded or creased side panel which joins the front and back panel.

The bag is also provided with a susceptor 20 which absorbs microwave energy and heats the corn kernels in contact therewith.

A bottom or glue zone 21 along the bottom internal edge of the bag, closes the bag along the bag's width from side-to-side. The diagonal stripping results from a fluted closure process that results in a strong seal. It will be noted that the zone is essentially linear and extends from side-to-side of the bag or transverse to the bags' length. Moreover, this glue zone is entirely internal.

This type of bag can be identified as a single gusset tube bag with a V-shaped bottom.

The bag is filled with corn kernels, oil and seasoning as suggested by the arrows in FIG. 1. The bag is then closed along the top which is more easily opened than the bottom. The top is only lightly sealed so to permit steam and other gases to exit the bag during popping. However, the bottom seal is stronger than the top seal.

The bag is folded in three sections into a packet with the center section 22 and susceptor 20 positioned downwardly, one end section 24 is folded thereover like a flap, and the other end section 26 is folded over the first flap.

Figure 3:
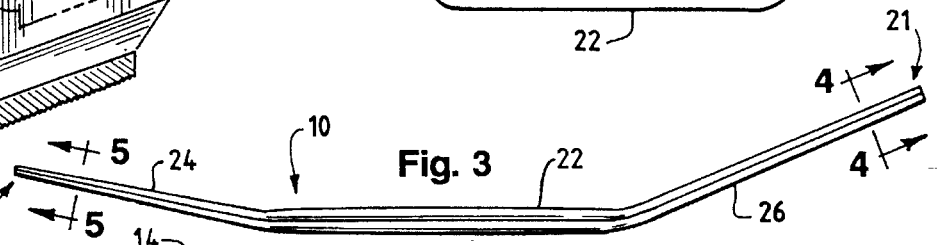
FIG. 3 is a side view of a closed but unfolded bag or packet to be positioned for use in a microwave oven for heating and popping.

The bag 10 may be opened and laid out as shown in FIG. 3 for microwaving, heating and popping.

Figure 4:
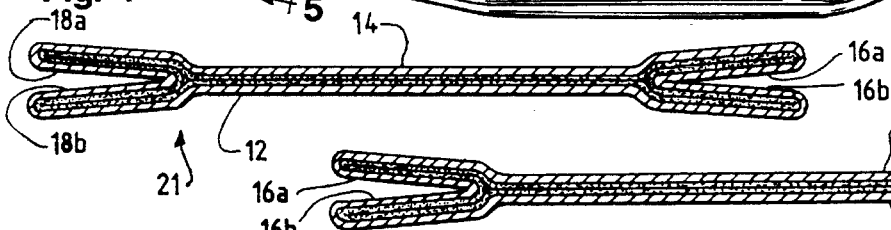
FIG. 4 is a sectional view taken along line 4—4 of FIG. 3 showing the bottom end construction before popping.
Figure 5:
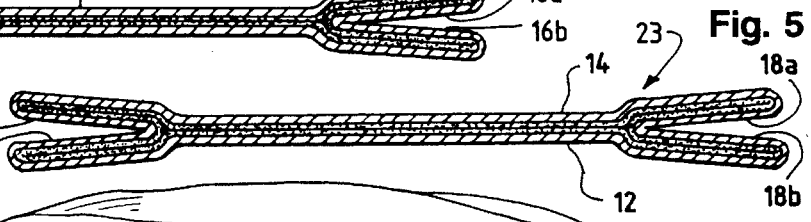
FIG. 5 is a sectional view taken along line 5—5 of FIG. 3 showing the top end construction before popping.

The construction, for the end seals or formations is seen in FIGS. 4 and 5. The bottom end formation is shown in FIG. 4. There the front panel 12 is secured to the back panel 14. The gusset 16 has two folded long folds or sections 16*a* and 16*b*. The gusset 18 has two folded sections 18*a* and 18*b*. It is seen that the gusset sections are not adhered to each other, but are adhered to a front or a back panel. Thus, fold 16*a* is bonded to back panel 14; fold 16*b* is bonded to the front panel 12; fold 18*a* to back panel 14; and fold 18*b* to front panel 12. Moreover, in order to assure a strong seal at the bottom, the glue or bonding agent is applied in a broad band 21 across the bottom using bonding techniques that result in the diagonal strips.

In other words, the bottom seal is essentially linear and relatively broad. The only bottom sealing is in the linear bottom zone and the extent of gusset section sealing is the same as for front-to-back sealing.

The bonding arrangement for the top end 23 is similar to the bottom end. However, the bottom bonding zone 21 is stronger than at the top bonding zone 23.

Figure 6:
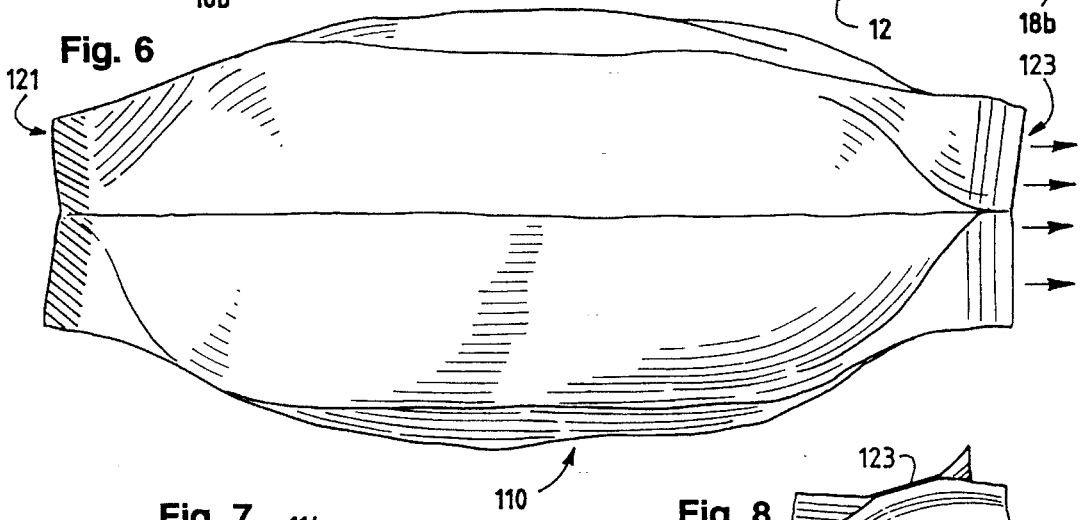
FIG. 6 shows a side view of the bag after expansion, corn popping and having a pillow-like shape.

During heating the corn inside the bag pops and the air expands. The bag puffs up to form the expanded or pillow shaped bag 110 of FIG. 6. At the top end 123 and bottom end 121, the gusset can open and can expand or the folds separate, all the way from the top end to the bottom end. Of primary significance is the fact that the gusset folds are free to open and expand away from each other so as to maximize the bag interior. In other words, the folds can move away from one another to open. Note the front panel 112, back panel 114 and gusset folds 116*a*, 116*b*, 118*a* and 118*b* as seen in FIG. 7.

The bonding technique permits the gusset folds to open and bag to expand while still sealing the end. By so doing, corn kernels are not trapped in the ends of the bag and a fuller or more efficient pop can be achieved. The foregoing results in a pillow shaped bag where the internal volume to bag surface area ratio is greater than before and minimizes tilting.

This becomes very important when the microwave is older, not operating at maximum efficiency or of low wattage. Under such conditions, this bag can maximize the kernel popping potential.

Figure 7:
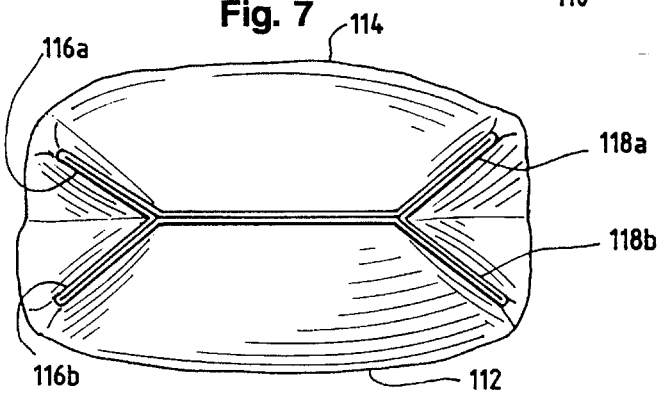
FIG. 7 is a view of the bottom end of the bag of FIG. 6.
Figure 8:
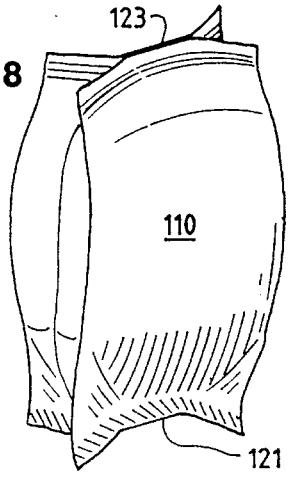
FIG. 8 is a front perspective view showing the bag standing in an upright position.

The end construction of this bag is shown in FIG. 7 after expansion. Here it is seen that the winged construction opens by the wings separating. At the bottom, the front panel 112 and back panel 114 are adhered together at the center. The gusset folds are adhered to the front or back panel on opposite ends of the center by the adhesive as discussed before. Similar freedoms are also found at the top end of the bag 123, but the bond is not as strong as at the bottom end 121 so that the top end is openable by the user and allows steam or heated air to escape (as suggested by the arrows in FIG. 6).

Here the front panel may be fully expanded so that an entire logo applied thereon can be seen.

Moreover, it has been found that due to the winged construction of the bag bottom, the bag can be stood on the bottom end in an upright position. This tends to be a convenient arrangement since only the top is open and popped corn can be removed without tipping or spilling the bag contents.

Various changes and modifications can be made to the embodiments of this invention without departing from the spirit and scope of this invention.

I claim as my invention:

1. An elongated pinch-style and tube-type bag construction for use in carrying corn and popping corn in a microwave oven, said bag being expandable from a flattened shape to a pillow-like shape, comprising:

(a) a front panel and a back panel constructed to be adjacent when the bag is flattened and spaced when the bag is expanded;

(b) a pair of gusseted side panels each of which are connected to the front panel and the back panel;

(c) a sealed top end;

(d) a sealed bottom end;

(e) a susceptor construction associated with the bag for receiving microwave energy and converting microwave energy to thermal energy for heating corn kernels to be popped therein;

(f) each of the seals for the top and bottom ends being only internal of the bag;

(g) the seal for the bottom end being stronger than the seal for the top end;

(h) each of the seals being essentially linear and transverse to the length of the bag; and (i) each side panel includes only one gusset which extends between the top end and bottom end of the bag and is secured to the front panel and the back panel;

so that upon expansion each gussett opens without external restraints and the bag assumes a pillow-like shape and the internal volume of the bag is maximized.

2. A bag as in claim 1 wherein each gussested side panel is a folded construction having only two folded sections, and each folded section is integral with a front or a back panel and at each end each fold section is adhered only internally to an adjacent front or back panel.

3. A bag as in claim 1 wherein only the tip and bottom ends are sealed closed, the bonding is internal and the gusset folds are constructed to separate from each other.

4. A bag as in claim 1 wherein when the bag expanded the front and back panels are substantially spaced apart, the top end is opened an amount effective to vent expanding gases, the bottom end is sealed, and the gusset sections have expanded and unfolded.

5. A bag as in claim 4 wherein the gusset, front and back panels for the bottom end form a winged construction where the front panel is secured to the back panel at the center and each gusset has a pair of folded sections and each section is secured to the front or the back panel.

6. A bag as in claim 5 wherein the bag is constructed to rest in the vertical position on the bottom wing construction.

7. A process for popping corn in a tube-type pinch-style bag in microwave oven including the steps of:

providing a bag having (a) a front panel and a back panel constructed to be adjacent when the bag is flattened and spaced when the bag is expanded, (b) a pair of gusseted side panels each of which are connected to the front panel and the back panel, (c) a sealed top end, (d) a sealed bottom end, (e) a susceptor construction associated with the bag for receiving microwave energy and converting microwave energy to thermal energy for heating corn kernels to be popped therein, (f) each of the seals for the top and bottom ends being only internal of the bag, (g) the seal for the bottom end being stronger than the seal for the top end, (h) each of the seals being essentially linear and transverse to the length of the bag, and (i) each side panel includes only one gusset which extends between the top end and bottom end of the bag and is secured to the front panel and the back panel, so that upon expansion each gussett opens without external restraints and the bag assumes a pillow-like shape and the internal volume of the bag is maximized;

applying microwave energy to the bag so as to interact with the susceptor, cause the corn kernels to pop and the bag to expand; and permitting the bag to expand along the gusset folds and to form a winged-center section at the lower end where the center of the front and back panels are adhered to each other, and the gusset fold sections adhered to the front panel or the back panel.

8. A process as in claim 7 where the bag expands to a pillow shape, has a large internal volume and bag tilting is minimized.

9. A process for making a pinch-style and tube-type bag to carry corn kernels and in which to pop the kernels and permit the bag to expand using microwave energy including the steps of:

providing a web of bag making material and a susceptor;

folding the web so that a front, a back and a pair of folded and gusseted side panels are formed and each side panel including only a single gusset;

locating the susceptor on a central portion of the front or back panel;

sealing the bottom end of the bag only on the inner surfaces thereof so that the gusset folds are secured to either the front or back panel, and applying the seal to form a transverse seal zone;

sealing the top end of the bag only on the inner surfaces thereof so that the gusset folds are secured to either the front or back panel, and applying the seal to form a transverse seal zone; and wherein the bottom end seal is stronger than the top end seal.

10. A process as in claim 9 wherein each of the top end seal and bottom end seal includes a seal zone extending from side-to-side transversely across the bag, and the width of the zone for the bottom end being greater than the width for the top zone.

* * * * *